US005532681A

United States Patent [19]

Peters et al.

[11] Patent Number: 5,532,681

[45] Date of Patent: Jul. 2, 1996

[54] PROTECTION DEVICE FOR POWER FREQUENCY MAGNETIC FIELDS

[75] Inventors: Aemil J. M. Peters, Houston, Tex.; Byron J. Masterson; Robert M. Abrams, both of Gainesville, Fla.

[73] Assignee: Bodysonics, Inc., Houston, Tex.

[21] Appl. No.: 387,631

[22] Filed: Feb. 13, 1995

Related U.S. Application Data

[63] Continuation of Ser. No. 139,434, Oct. 20, 1993, abandoned, which is a continuation-in-part of Ser. No. 66,573, May 26, 1993, Pat. No. 5,420,581.

[51] Int. Cl.[6] ..... G08B 23/00

[52] U.S. Cl. ..... 340/573; 340/540; 340/600; 324/258

[58] Field of Search ..... 340/600, 572, 340/573, 540; 324/72, 258, 257

[56] References Cited

U.S. PATENT DOCUMENTS

| | | | |
|---|---|---|---|
| 3,750,017 | 7/1973 | Bowman et al. | 324/72 |
| 3,927,375 | 12/1975 | Lanso et al. | 340/600 |
| 5,109,421 | 4/1992 | Fox | 381/90 |
| 5,119,426 | 6/1992 | Roberts | 381/56 |
| 5,150,051 | 9/1992 | Friedman et al. | 340/600 |
| 5,155,442 | 10/1992 | Mercer | 340/620 |
| 5,168,265 | 12/1992 | Aslah | 340/600 |
| 5,256,960 | 10/1993 | Novini | 340/600 |
| 5,309,097 | 5/1994 | Bill et al. | 340/600 |
| 5,311,130 | 5/1994 | Bill et al. | 340/600 |

OTHER PUBLICATIONS

Iovine, J., "Electromagnetic Fields and Your Health", Mar. 1993 *Popular Electronics,* pp. 31—34 and 85.

Environmental Instruments advertisement, undated (1 page).

The TriField(198 ) and Magnetic Scanner electromagnetic meters, undated, source unknown, pp. 1–4.

ENERTECH Consultants EMDEX product brochure, undated (4 pages).

Iovine, J., "Electromagnetic Fields and Your Health," Mar. 1993, *Popular Electronics,* pp. 31—34 and 85.

Gerhardt, K., "Prenatal and Perinatal Risks of Hearing Loss," *Seminars in Perinatology,* vol. 14, No. 4, Aug. 1990, pp. 299–304.

Lande, N., et al., "Is Occupational Noise Exposure During Pregnancy a Risk Factor of Damage to the Auditory System of the Fetus?," *Am. J. Indus. Med.,* 10:427–435, 1986.

*Primary Examiner*—John K. Peng
*Assistant Examiner*—Benjamin C. Lee
*Attorney, Agent, or Firm*—Maryam Bani-Jamali

[57] ABSTRACT

The present invention is a magnetic field warning device suitable for protecting fetal health by alerting the mother whenever she or her fetus is exposed to alternating magnetic field levels which exceed predetermined levels. The device may also be used by anyone concerned about exposure to excessive alternating magnetic fields. The device comprises a magnetic field sensor for sensing alternating magnetic fields of arbitrary orientation, a detector for obtaining the magnitude of the sensed magnetic field, a filter for reducing the possibility of false alarms, a comparator for comparing the magnitude of the sensed field to a predetermined magnitude, and an alarm mechanism. The predetermined magnitude may optionally be adjustable, and the alarm mechanism is designed to minimize unwanted coupling of vibration to the user's abdomen. The device may be made small enough to be easily clipped on a belt so as to be worn by pregnant women at the abdominal level to monitor magnetic field exposure at the abdomen. With the preferred circuitry, magnetic fields may be measured in the range of 0.5–200 mGauss over a frequency range of 4 Hz–50,000 Hz.

6 Claims, 4 Drawing Sheets

PROTECTION DEVICE FOR POWER FREQUENCY MAGNETIC FIELDS

This application is a continuation of application Ser. No. 08/139,434 filed on Oct. 20, 1993, in United States of America entitled "PROTECTION DEVICE FOR POWER FREQUENCY MAGNETIC FIELDS", now abandoned, which is a continuation-in-part of application Ser. No. 08/066,573, filed May 26, 1993 entitled "MATERNAL SOUND LEVEL DEVICE AND METHOD FOR PROTECTING FETAL HEARING" now U.S. Pat. No. 5,420,581.

BACKGROUND OF THE INVENTION

I. Field of Invention

The present invention relates to a device that warns a pregnant woman when magnetic fields are present that may be harmful to the developing fetus and/or herself.

II. Brief Description of the Prior Art

Recent reports of increased risk of leukemia [Stone, R. Polarized Debate: Emf's, and Cancer. *Science,* 258:1724–1725, 1992] and other cancers resulting from exposure to electromagnetic radiation have elicited growing public health concern. The human data is reinforced by laboratory in vitro and in vivo studies suggesting changes in normal nocturnal pineal melatonin content [Wilson, B. W., Anderson, L. A., Hilton, D. I. et al. Chronic exposure to 60-Hz electric fields: effects on pineal function in rat. *Bioelectromagnetics,* 2:371–380, 1981], calcium homeostasis [Bawin, S. M., Adey, W. R., Sensitivity of calcium binding in cerebral tissue to weak environmental electric fields oscillating at low frequency. *Proceedings of the National Academy of Science, USA,* 73:1999–2003, 1976], and fibroblast protein synthesis [McLeod, K. J., Lee, R. C., Ehrlich, H. P. Frequency dependence of electric field-modulation of fibroblast protein synthesis. Science 236:1456–1469, 1987].

Extremely low frequency electromagnetic fields (in the range of power frequencies; 50–60 Hz) are pervasive in our modern industrialized world, with measurable levels near any appliance powered by electricity. While electric fields are easily shielded to prevent exposure, the magnetic fields resulting from alternating current flows ere much more difficult to diminish by usual barriers. Magnetic fields are created by energized coils, such as those in fans, video display terminals, pencil sharpeners and heaters. At home, motor driven clocks, telephone answering machines on night stands, wall powering adapters, and waterbed and electric blanket heaters could provide exposure to magnetic fields for a significant period of each 24 hour day.

Virtually nothing is known about how magnetic fields affect developing embryos and fetuses. There are numerous physical and chemical agents that are known to alter organ maturation during so-called "vulnerable periods" of development and growth. In view of this fact and the uncertainties over "safe" levels of exposure, avoidance of magnetic fields at home, work and play is believed to be prudent behavior by all pregnant women.

A detection and warning device for developing embryos and fetuses has been previously described by the same inventors in commonly-owned U.S. patent application Ser. No. 08/066,573, filed May 26, 1993, and registered on May 30, 1995, under U.S. Pat. No. 5,420,581 the disclosure of which is hereby incorporated by reference. The device described in U.S. Pat. No. 5,420,581 provided warnings when excessive sound levels were present. It was not designed to detect and warn against magnetic fields.

Although existing magnetic field meters are known that detect magnitudes of magnetic fields of arbitrary orientation, these devices do not present an audible alarm when fields of certain levels are exceeded. Furthermore, existing field meters are not designed to be worn at the abdominal level. Because in situations of practical concern, magnetic fields drop rapidly as the distance between the source of the magnetic field and the target increases, and because the penetration of magnetic fields into the human body is nearly perfect, the level of exposure must be evaluated as close as possible to the target location, in this case the fetus.

It would thus be desirable to have a magnetic field sensor capable of detecting arbitrarily oriented magnetic fields in proximity to a human abdomen and of providing an audible warning when such fields exceed a predetermined level, and to provide such a sensor in a device that is capable of being comfortably carried near the abdomen. Because such a warning device is useful for detecting magnetic fields harmful to a human fetus, it also would be desirable to avoid exposure of the fetus to excessive noise due to the audible alarm.

SUMMARY OF THE INVENTION

To meet the need for a such a magnetic field detection and warning device, the present invention compromises a maternal power frequency magnetic field level device for protecting the abdominal organs of a woman and a fetus for exposure to magnetic fields that may be worn by a (pregnant) woman at the abdominal level. The power frequency magnetic field level device comprises a magnetic field sensor capable of sensing a time-varying magnetic field of arbitrary orientation and producing an electrical signal indicative of the approximate magnitude of the field. This electrical signal is compared with an electrical signal representative of the magnitude of magnetic field of a predetermined value, and an alarm is activated if the comparison indicates that the sensed magnetic field magnitude is greater than a field of approximately the predetermined value.

In a preferred embodiment, three orthogonally-positioned coils small enough to fit inside the magnetic field detection device and wound about ferrite cores, are provided. In time-varying magnetic fields, these coils generate currents that are converted to voltage variations. Separate preamplifiers amplify these voltage variations, producing outputs that are connected to three full wave rectification detectors. The outputs of the three detectors (for the x, y and z directions) are mixed in a diode network and fed into an averaging circuit that provides different selected charging and discharging time constants to avoid false alarms that would otherwise be caused by short lasting magnetic pulses. The output of the averager is fed into a level comparator which compares the averager output with a value indicative of a predetermined magnetic field magnitude. The output of the comparator is fed into an alarm circuitry, which can include visual, acoustical, or vibrating alarms, or a combination of different alarms, which are activated when the comparator indicates the presence of a magnetic field of greater magnitude than one of approximately the predetermined magnitude, which may optionally be made adjustable. Because various types of alarms can be used, a unit may be easily adapted for use by visual or auditory handicapped persons.

Once an alarm is perceived by a pregnant woman using the device or by others in the vicinity, the woman can remove herself and the fetus from the possible hazards presented from the detected magnetic field or take other preventative measures, such as turning off or relocating an appliance; e.g. a wall powering adapter to a location where exposure at the abdominal level is reduced.

Because the device in its preferred embodiment is portable, monitoring of magnetic field levels can be done continuously while engaged in such occupational activities as operating electric equipment or working in environments in which electric fields are abundant. Activities in which magnetic field exposures to the body occur are common. Such activities include as operating a personal computer, ironing clothes, sewing or using a handheld electric mixer in food preparation.

Another important advantage of the device in its preferred embodiment is the fact that it provides an enclosure adapted to be worn at the abdominal level, near the target location, namely the fetus. Moreover, the fetus is protected as much as possible from exposure to the audible alarm by using means for minimizing acoustical coupling of vibrations which separates means for generating the audible alarm from an enclosure for the alarm means in order to minimize acoustical coupling of vibrations from the alarm means to the woman's abdomen. The device can, however, be physically relocated, e.g., to the location of the head or to other parts of the body to be evaluated for magnetic exposure.

It is therefore an object of this invention to detect magnetic fields at the abdominal level so that they can as accurately as possible predict fetal exposure since the abdomen is transparent to magnetic fields. Given the fact that a fetus can be as close to the interabdominal wall as 3–5 centimeters, the extraabdominal level does accurately describe fetal exposure if the device is worn at the abdominal level. In addition, the device is intended to warn for levels of magnetic fields that include all products of pregnancy, as well as the organs of reproduction in general. The device also has application in time periods when a woman is not pregnant if she wishes to be informed of possible hazardous levels of magnetic fields at the abdominal level.

It is a further object of the present invention to activate an alarm when the magnetic field exceeds an approximate predetermined level indicating that a possible hazardous situation exists at the abdominal level, so that the pregnant woman can take steps to reduce possible risks from exposure to excessive magnetic fields.

These and other objects of the invention will become apparent to one skilled in the art from inspection of the drawings and the accompanying detailed description. It will, of course, be understood that the invention is not limited to the particular preferred embodiment illustrated in the accompanying drawings and described in detail below, and that additional embodiments within the scope and spirit of the invention will be readily apparent.

DESCRIPTION OF THE PREFERRED EMBODIMENT

For ease of description, the mechanical and electrical details of the preferred embodiment are presented in separate sections below.

Mechanical Portion

Figure 1A:
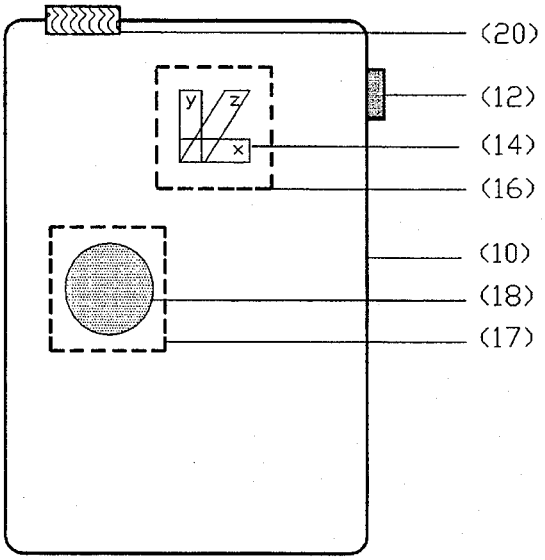
FIGS. 1*a*, 1*b*, and 1*c* show front, side, and rear views, respectively, of a preferred embodiment of the invention illustrating the positions of the different components that comprise the unit.
Figure 1B:
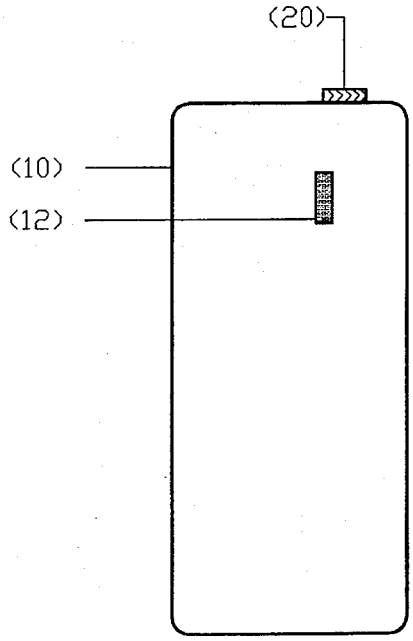

As shown in FIG. 1*a*, front view, the preferred embodiment of the invention comprises an enclosure 10 that has dimensions of a portable unit three orthogonally placed detector coils 14, an electronic circuitry, an acoustical alarm, and a battery powering device. The present unit is capable of fitting into an enclosure 10 measuring 9 cm×6 cm×3 cm, although further miniaturization could reduce the necessary enclosure size. Since the size of the device is dictated mainly by the size of the three detector coils 14, the electronic circuitry (which could be reduced to a single integrated circuit), the size of the acoustical alarm, and the type of battery powering device, the size of the device could, therefore, be smaller than the size of the device mentioned above, and reduced to approximately one-half of this size. If combined with a portion that warns of the presence of possibly hazardous sound levels, a small microphone (as described in aforementioned U.S. Pat. No. 5,420,581) could be added. Since the microphone could be as small as 1 cm×1 cm×1 cm (height x width x depth), and only a small number of electronic components have to be added, it would be possible to incorporate these additions into the same size (or even a smaller) enclosure. On the other hand, a larger enclosure may be more convenient for some purposes. For example, memory and interface electronics could be included to retain a record of magnetic fields and/or sound exposure over time. A larger enclosure may make it more convenient to provide connectors for downloading such data to an external computer. The enclosure 10 is preferably made of plastic and is used in conjunction with existing clothing material such as a pair of slacks, a drape and/or a belt; therefore it does not make skin contact with the user. The unit is switched on and off by switch 12. The device is intended to be worn by a pregnant woman with the device incorporating the three orthogonal coils 14 positioned at the level of abdominal segment of the body.

The three coils 14 may be wound on either a ferrite or an air core. Physical vibration of the coils 14 could result in the unwanted detection of static magnetic fields, such as that of the earth, thereby causing false alarms. For this reason, the coils 14 are housed in a silicon rubber insulator 16 to prevent false alarms due to such vibration.

A buzzer 18 is provided to generate a pulsating high pitched sound for several seconds when the magnetic fields in the vicinity of the user exceed a selected predetermined level. Electronic circuitry (not shown in FIG. 1*a*) may be used to produce the pulsations. The buzzer 18 is preferably a magnetic or piezo-electric type, but may be of any type that emits a clear and loud high-pitched acoustical signal directed principally in one direction. A high-pitched buzzer is preferred because higher frequency sounds are more attenuated by the abdominal wall and underlying structures; therefore, the alarm does not expose the fetus to potentially hazardous sound levels. A commercially available piezo electric buzzer suitable for use in the preferred embodiment is available from Panasonic as Model No EFBCC28C15. This buzzer model emits sounds with a frequency of approximately 2.8 kHz (±0.2 kHz).

Sound pressures produced by buzzer 18 are specifically intended to be louder than the high ambient sound levels that may occasionally surround the user of the device. The sound that the buzzer 18 emits is pulsating and high pitched in character to attract maximum attention from the user because it is believed that pulsating high pitched sounds are more effective for this purpose than sounds presented in a continuous manner. The preferred buzzer 18 directs its acoustical emission in one direction only, and is mounted to direct acoustic emission forward and away from the abdominal segment to further reduce the possibility of exposing the fetus to loud sounds, while retaining the ability to alert the pregnant woman in the presence of high levels of ambient noise. Silicon rubber is used as means for minimizing acoustical coupling of vibrations 17. Silicon rubber is placed between the buzzer 18 and the enclosure 10 and separates the buzzer 18 from the enclosure 10. When this buzzer 18 is placed inside of the enclosure 10 in order to minimize acoustical coupling of vibrations from the buzzer to enclosure 10 at the point from which acoustic emission takes place, which is an opening 17 in the front of enclosure 10 (see FIG. 1*a*, front view). Were this means for minimizing acoustical coupling of vibrations 17 not provided, vibration of the enclosure 10 caused by buzzer 18 may be coupled to the skin of the abdomen, thereby exposing the fetus to unwanted sounds. [Fetal Vibroacoustic Stimulation Test: Vibrator Response Characteristics in Pregnant Sheep Postmortem," Aemil J. M. Peters and Robert M. Abrams, Ph.D., Obstetrics and Gynecology 1993, 81:181–184]. Because the means for minimizing acoustical coupling of vibrations is placed between the means for generating the audible alarm and the enclosure for the alarm means, the means for generating the audible alarm is separated from the enclosure for the alarm means and coupling of vibrations from the alarm means to the person's abdomen or to other organs of the person is minimized.

A flashlight 20 is provided which comprises two or more light emitting diodes (LEDs). Alternately, a small high intensity light bulb may be used in place of the LEDs. The flashlight 20 provides a visual alarm that will be activated whenever the buzzer 18 is activated to alarm the user in dark or noisy environments, such as in mining industries, or during work at night hours, or any other situation in which maternal hearing is limited and the acoustical alarm of the buzzer 18 alone is insufficient to alarm the user. A switch (not shown) could optionally be provided to select either the buzzer 18, the flashlight 20, or both to be activated as alarms.

The device could optionally be provided with additional electronic circuitry allowing the alarm signal to be transmitted through cable or by means of wireless transmission and receivers to another physical location. Flashlight 20 and switch 12 are selected to not exceed the overall dimensions of the enclosure.

Figure 1C:
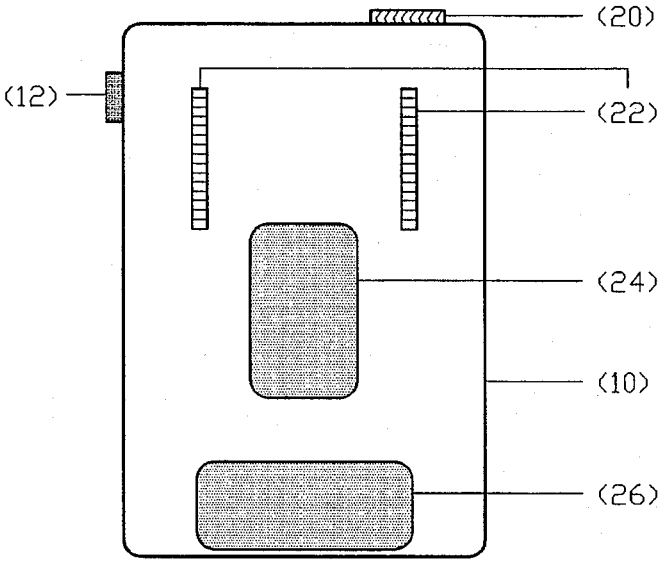

The various preferred mounting options avoid skin contact with the user by ensuring that there is a layer of clothing between the user and the device, thereby further reducing exposure of the fetus to alarm sounds generated by the device. The device can be worn on any clothing and used during recreational or professional activities that require special protective clothing. The mechanical dimensions of the preferred embodiment make it possible to use the device as a portable device. The preferred embodiment may be worn in the pockets of existing clothing. In addition, as illustrated in FIG. 1*c*, two belt supporters 22 provide support to use the device with an existing belt. For users wearing a wider belt or slacks, a belt clip 24 is provided, thereby providing additional mounting possibilities. The flashlight 20 is observable in any of the various mountings of the preferred embodiment, and also when it is detached from the body, either on its front or back surfaces or on any of its lateral sides. A battery compartment 26 is easily accessible for replacement of the battery by removing the cover of the compartment 26.

Electronic Portion

Figure 2:
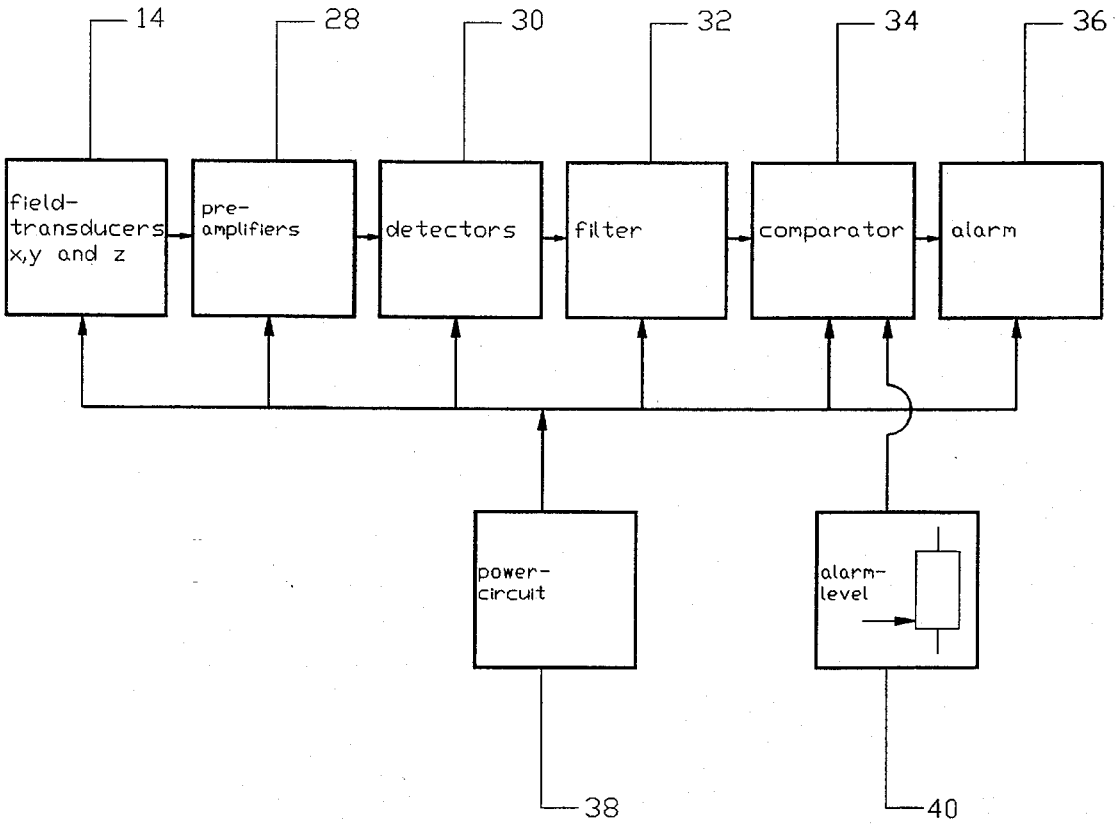
FIG. 2 shows a block diagram of the electrical circuitry of the preferred embodiment.

FIG. 2 is an electrical block diagram of the preferred embodiment of the present invention. This device comprises three magnetic field transducers 14 for detection of magnetic fields, three preamplifiers 28, three detectors 30, a filter 32, a comparator 34, an alarm 36, a power circuit 38, and an alarm level potentiometer 40. In the preferred embodiment magnetic fields are detected in the range of 0.5 mGauss–200 mGauss with a flat frequency response over a range of about 4 Hz–50,000 Hz. The electronic circuitry of the device could be altered to detect weaker or stronger magnetic fields, and/or frequencies outside of the above range. The user of the device is alerted to magnetic fields that are possibly dangerous to the fetus or herself by alarm 36. The alarm level can be adjusted such that alarms will be presented when magnetic field strengths are detected that exceed that of an approximate predetermined level as set by alarm level potentiometer 40. Since the threshold level of magnetic exposure at which alarms will be presented can be varied, the user is able to select alarm levels appropriate for either adults or fetuses. The device could be expanded with additional sets 78, 80 and 82 of three x-y-z orthogonal coils, as shown in FIG. 4, allowing it to detect magnetic fields simultaneously at several locations around the body, e.g., the front, the back, and both lateral sides of the abdomen. These coils could be arranged on or as part of a belt 76 that may be worn by the user, with the belt containing and protecting the necessary electrical wiring 88 which is connected to enclosure 10 with connector 86. Additional coils 84 could also be placed at non-abdominal parts to warn of exposure to, e.g., the head of an adult. Such expansion would also require additional electronic circuitry. Each detector coil would require a preamplifier similar to preamplifier 28 of FIG. 3, and a detector similar to detector 30 of FIG. 3, but all detector outputs could be connected by diodes to a single junction point 66 in FIG. 3, since, in general, it is sufficient to indicate an alarm when any single detector's output exceeds a selected value, as explained in more detail below. Thus if one decides to use 3 mGauss as upper limit for adult exposure at, e.g., the level of the head, one could then set due to the effect of distance the level of alarm for the fetus at e.g. 6 mGauss, therefore incorporating the additional attenuation related to the extra distance between magnetic field and fetus, as compared to the extra abdominal wall. However, if concern exists that fetal exposure to magnetic fields is more pathologic than believed before, especially at early gestational ages, one could choose to set levels of alarm such that alarms will be presented even before an adult exposure limit would have been exceeded. For example, fetal exposure could be set not to exceed 1 mGauss whereas adult exposure could be tolerated at 3 mGauss.

The main objective of the device is to evaluate exposure at the power frequency of 50 or 60 Hz. Nevertheless, the device is provided with an essentially flat frequency response from about 4 Hz to about 50,000 Hz because there is no evidence to indicate that fetal outcome or human health in general is correlated with the frequency of alternating magnetic field to which a person or a fetus is exposed. The unit thus evaluates magnetic field exposure at higher frequencies, e.g., generated by pulsative energized DC motors (e.g. electric toothbrush) and some video display systems as well as lower frequencies. Thus the mother is alerted to magnetic fields over a wide frequency range and range of levels which may be harmful to the fetus and/or organs of reproduction. If evidence is found to correlate the harm caused by an alternating magnetic field with the frequency of the field, conventional filtering may be employed in the electrical circuitry to compensate for this effect, e.g., by tailoring the frequency response of the preamplifiers.

Figure 3:
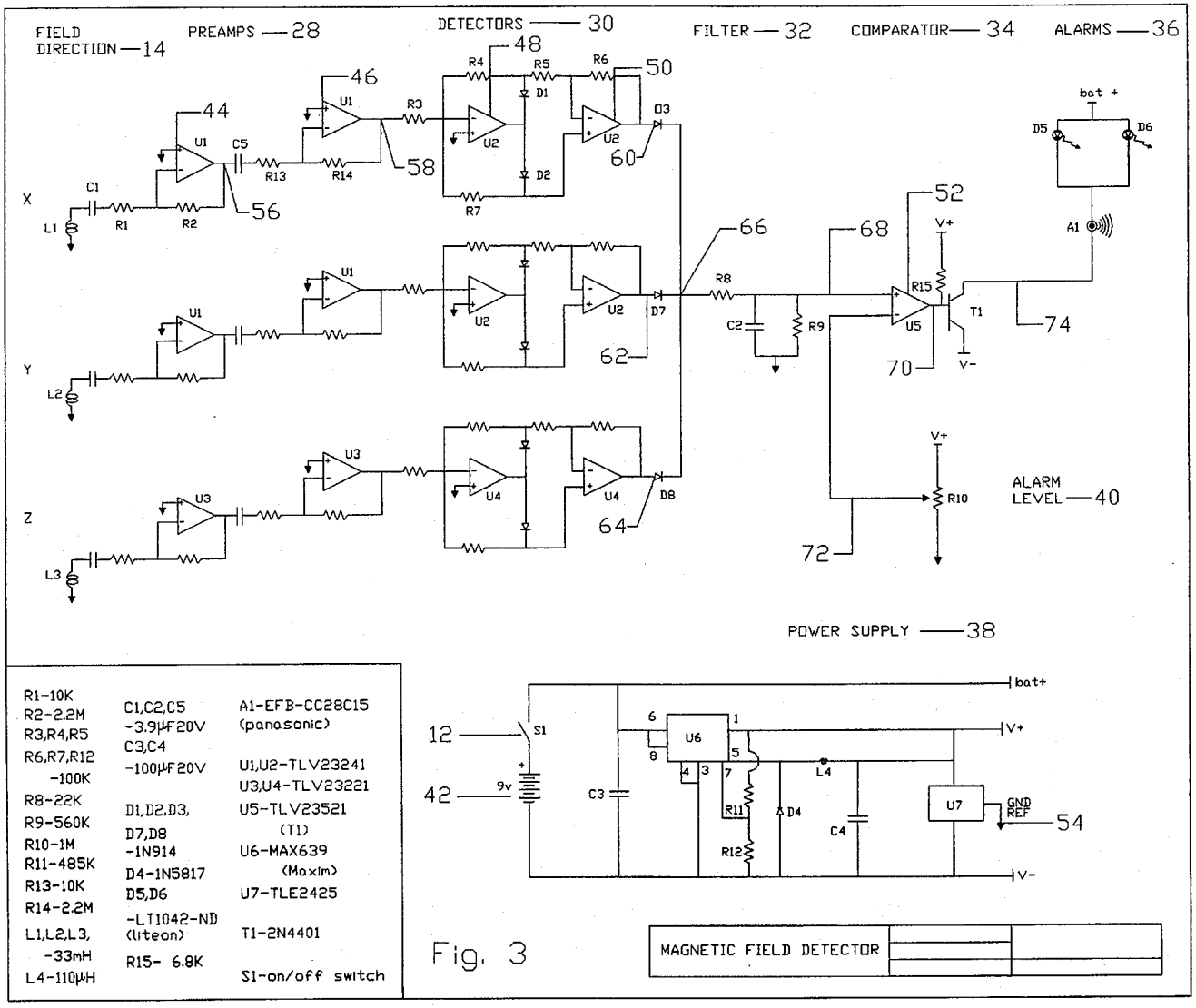
FIG. 3 shows a detailed electrical schematic diagram of the preferred embodiment.
Figure 4:
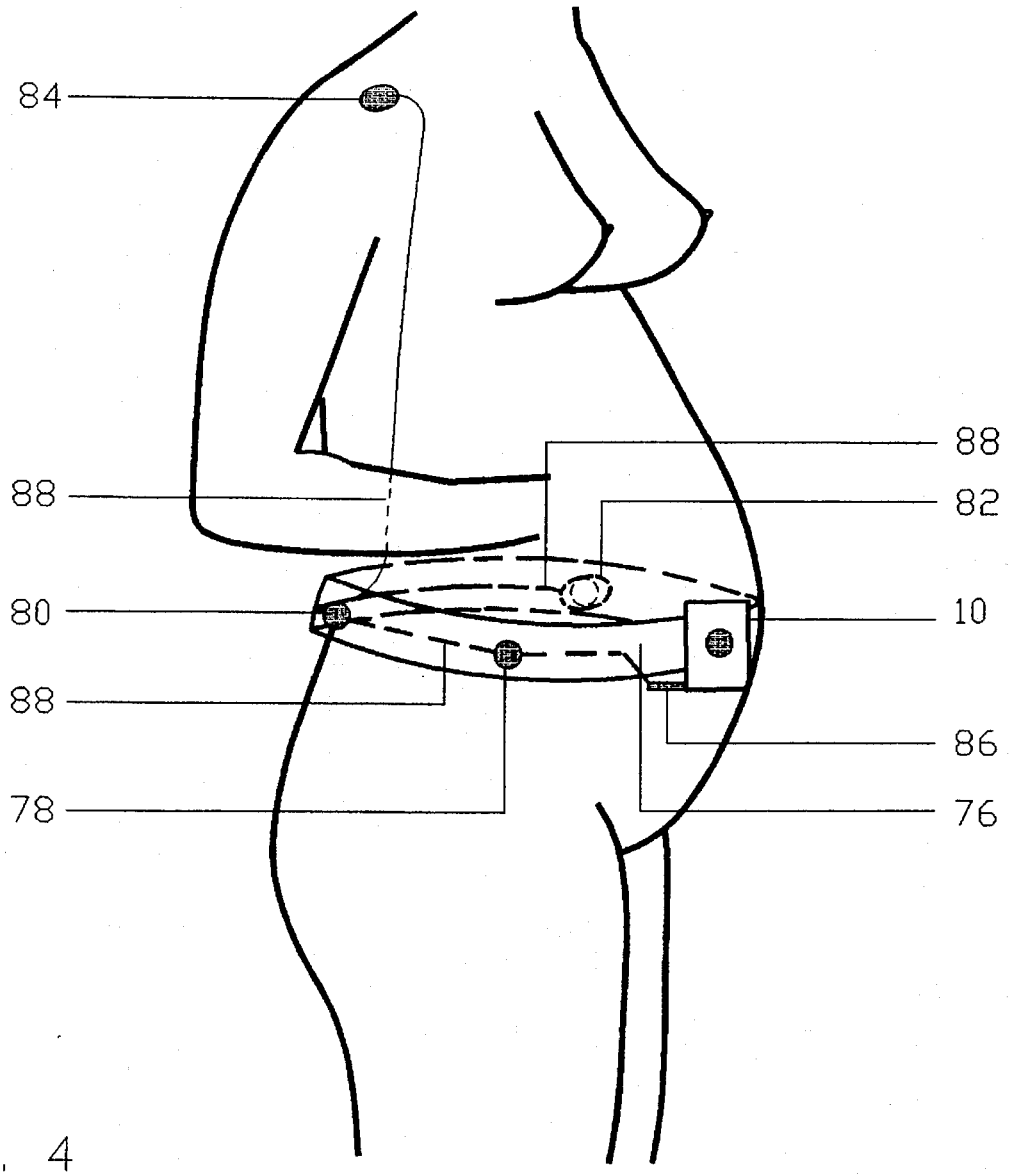
FIG. 4 shows optional additional sensors and an optional belt with wiring connecting the sensors to the device.

Referring now to FIG. 3, as well s to FIGS. 1*a*, 1*b*, 1*c* and FIG. 2, the electronic circuit which resides in the enclosure 10 is on a printed c board (not shown) and is connected to a battery 42 which is put in series with the on/off switch 12 to act the circuitry. Operational amplifiers 44, 46, 48 and 50 are of any low current consumption type with a bandwidth suitable for the present application. Because current draw is minimized, the preferred embodiment can operate using a standard 9-volt transistor radio battery 42 for more than 60 hours. In this embodiment Texas Instruments TLV23241 and TLV23221 amplifiers are used, the former providing four operational amplifiers or package, and the latter providing two. Comparator 52 s a differential comparator, which, in this embodiment, is a Texas Instruments TLV23521.

Several voltages were required to be derived from the 9 volt battery 42. These voltages are generated by power supply 38. "Bat +" is the full battery voltage, which is required in this embodiment only to power the alarms 36 which comprise D5, D6, and A1. A lower voltage is derived using a Maxim MAX 639 step down switching regulator which gives V+ (+5 Volts) with respect to GND REF 54, the potential of which is set by resistors R11 and R12. Diode D4 is an overvoltage protecting diode. Network L4/C4 is a smoothing network for V+. In order to have AC signal capability in the preamps, the ground reference is generated halfway between V+ and V− using a virtual ground generator Texas Instruments TLE2425 (U7). The negative supply for the preamps is V− at −2.5 Volts with respect to GND REF 54. Capacitor C3 stabilizes the battery voltage 42.

Magnetic fields are sensed in three directions by using three orthogonally placed 33 mH coils L1, L2, L3 (ferrite core wound). Time varying fields generate currents in the coils L1, L2 and L3 which are converted to voltages and amplified by the preamplifiers (preamps) 28. The field detector and preamplifier circuits for the x, y, and z directions are identical, therefore, only the circuit for the x direction need be discussed in detail. The coils L1, L2 and L3 (for the x, y and z directions) are connected with one terminal to ground reference (GND REF) 54 and with one terminal through a capacitor C1 and resistor R1 to an amplifier 44 of which gain is determined by the ratio of resistors R1 and R2, which in the preferred embodiment is approximately 220. This gain is selected to provide enough amplification of the signal on line 56 such that after further amplification by amplifier 46, in the preferred embodiment, the signal on line 58 is full-wave rectified with the detector built around operational amplifiers 48 and 50. Amplifier 44 also buffers the coil signal on line 56. A total gain on the order of 40,000–50,000 is desirable. Although this gain is attainable with a single operational amplifier, the use of two cascaded stages is preferable to avoid the bandwidth limitations of single-stage amplifiers and to avoid oscillations that may occur in a high-gain amplifier in which input and output circuits are in close proximity.

Individual preamp stages are built around operational amplifiers 44 and 46. The gain of the second stage of amplification is determined by resistors R13 and R14 and is also approximately 220. Both amplifier 44 and 46 act as a 6 dB/octave high-pass filter. The cut-off frequency is determined by the values of resistor R1 and capacitor C1 and resistor R13 and capacitor C5, respectively, and is set, in the preferred embodiment, at approximately 4 Hz. Amplifier 44 additionally acts as a low-pass filter, with a cut-off frequency of 48,230 Hz (i.e., about 50,000 Hz), which is determined by the inductance of coil L1 and resistance of resistor R1. These cut-off points are set at these frequencies to provide an essentially flat frequency response over a wide range of commonly encountered frequencies, including power lines, motors, CRT's and pulsative circuitry. It should be noted, however, that the invention is not limited to this frequency range. The output of the first stage of amplification as on line 56 is coupled by condenser C5 to the second stage of amplification to prevent DC generated in the first stage from being amplified. The dynamic signal range in these stages is approximately one half of the V+ to V− power supply source range, which, in the preferred embodiment, is ±2.5 volts with respect to the virtual ground reference 54. The gain of preamplifiers 28 is selected to avoid clipping of signals on lines 56, 58 and 60 resulting from magnetic fields detected by coils L1, L2 and L3 over the entire preferred frequency range and preferred magnetic field strength range to be measured by the device. After amplification by amplifiers 44 and 46, the signal on line 58 is then fed into a detector comprising operational amplifiers 48 and 50 to obtain a single value representative of the magnitude of the detected magnetic field. The detector in the preferred embodiment is a full wave detector, which allows selection of the maximum magnitude of the vector component of the field irrespective of their relative phase and allows the detection of pulsed signals having one Measurable vector component, such as may be generated by pulse-driven DC motors.

To obtain the correct magnetic field magnitude of an arbitrarily oriented magnetic field, the square root of the sums of the squares of the magnitude of the x, y and z vector components should be computed. In the preferred embodiment, the largest magnitude of the magnetic field component detected by one of the three orthogonal detectors is incorporated in evaluating magnetic exposure at any given time. To compensate for this deviation from the true magnitude (which reaches a maximum of about 73% higher than that which is sensed, when the magnitude of the field is the same in all three orthogonal directions), the alarm sensitivity level could be increased by this percentage to compensate for this difference. The principal effect of this compensation is to provide an increased margin of safety for the magnetic field exposure. However, by using the simplified maximum-of-n detector in the preferred embodiment, additional sensors, as discussed above, may easily be added, thereby making it possible to provide an alarm when the maximum field is exceeded at any one of several locations where these added sensors may be placed around the body.

The signal on line 58 which represents the output of the preamplifiers 44 and 46 is thus fed into the detector which is built from R3, R4, R5, R6, R7, D1, D2 and operational amplifiers 48 and 50. DC representative signals of magnetic fields as detected in the x, y and z directions by the coils L1, L2 and L3 are present as output DC signals from the detectors on line 60, 62 and 64. The maximum detector output voltage appears on line 66 because of the presence of diodes D3, D7, and D8, which comprise a maximum-of-3 detector. Signals on line 66 are fed into a filter circuit 32 which has separate charging and discharging time constants. These time constants can be adjusted independently by changing the resistors R8 and R9, and are set, in the preferred embodiment, by the product of R8 and C2 and the product of C2 and R9 respectively. The charge time constant, which is preferably about 80 msec, avoids alarms due to very short transient magnetic field pulses. The discharge time constant is about ± 2.3 sec, which also determines the maximum time this DC signal is presented on line 68 as input for comparator 52. Comparator 52 is a high input impedance, low power Texas Instruments comparator TLV23521. A NPN transistor T1, industry standard type 2N4401, is driven with the output of comparator 52 as on line 70 to shift the voltage levels to use the full 9 volt battery voltage to drive the alarms 36. The alarm level is set by a 1 Megohm variable resistor R10 connected between V+ and GND REF 54. Variable resistor R10 will allow one to set the alarm level over a wide range of 0.5–200 mGauss. No buffering of the Voltage on line 72 is necessary due to the very high input resistance of the comparator 52.

If the voltage on line 68 exceeds the voltage set by R10 on line 72, then the voltage on line 70 will change, T1 will conduct, the voltage on line 74 will change, and alarms 36 will be activated. Resistor R15 ensures correct biasing for the signal on line 70. The alarms 36 in the preferred embodiment comprise two parallel light emitting diodes D5 and D6, which are Liteon model LT 1042-ND LEDs containing integral flashing circuitry. These LEDs were put in series with an audible alarm A1, which is a piezo electric buzzer containing its own oscillator. The use of the specified LEDs and the piezo electric buzzer with its own oscillator reduces the need for external components to generate the preferred flashing visual alarm and the preferred high pitched pulsating audible sound. When the LEDs are turned on and off by T1, they also turn the audible alarm A1 on and off resulting in the pulsating high pitched audible sound. Since the two LEDs do not flash exactly in synchronization due to tolerances in the integral flashing circuitry of diodes D5 and D6, the varying phase creates a distinct slow warble in the sound of the audible alarm which varies continuously, thereby strongly alerting the user. If a warbling sound is not preferred, either diode D5 or D6 could be eliminated. However, if more warbling is preferred, the device could be expanded by putting more LEDs similar to D5 and D6 in parallel with existing D5 and D6.

Pulsed warbling sounds are preferable because these types of sounds are believed to have a more effective alerting effect on a person than a continuous sound. The sound produced by buzzer A1 should be louder than the sound already present in the environment of the user of the device. Alternately, a vibrating transducer may be used with a suitably modified alarm circuit. Such a transducer may be provided with wires and be separable from the enclosure and placed on a nonabdominal part of the body for visually and auditorily handicapped users.

The types of electrical components used make it possible for many of the components to be integrated into a single chip. Alternately, or in addition to such integration, small surface-mount components could be used to produce a miniaturized device. Moreover, by altering the levels of magnetic exposure at which an alarm will be presented with the adjustable alarm 40, the usefulness of the protective device could be extended to children and adults as well as to fetuses, as well as to different body parts in adults and children, such as the head or chest. Another advantage of the device is that additional sets of circuitry may be added, including additional magnetic field detection coils, preamps and detectors, thus allowing simultaneous evaluation of magnetic fields at different body parts simultaneously. The outputs of the additional detectors could be added on line 66 (see FIG. 3).

What is claimed is:

1. A portable magnetic field detection device to alert a person when an ambient low-frequency magnetic field of arbitrary orientation has a magnitude exceeding a predetermined value, said value being adjustable, the portable magnetic field detection device comprising:

(a) magnetic field detection means responsive to the ambient low-frequency magnetic field irrespective of the magnetic field's orientation for generating a first electrical signal representative of the magnitude of the magnetic field, said magnetic field detection means comprising:

(i) three orthogonally placed coils, fitted inside the magnetic field detection device, for simultaneously detecting orthogonal components of the ambient low-frequency magnetic field and for producing outputs indicative of the magnitude of the orthogonal components of said magnetic field, and (ii) means for combining the outputs indicative of the magnitude of such orthogonal components of said magnetic field to generate the first electrical signal;

(b) comparator means responsive to the first electrical signal for comparing the first electrical signal with a second electrical signal representative of the predetermined value, and for generating a third electrical signal when the first electrical signal exceeds the second electrical signal; and (c) alarm means, comprising visual and acoustical alarm means, responsive to the third electrical signal for alerting the person when the magnitude of the ambient low-frequency magnetic field exceeds the predetermined value;

(d) means for placing the device at the level of and in proximity to the person's abdomen to accurately detect the exposure of a fetus and abdominal organs of the person to the low-frequency magnetic field;

(e) a switch means for controllably switching the alarm means on and off;

wherein the detection device protects the person's fetus and abdominal organs from over-exposure to the low-frequency magnetic field while isolating vibrational effects of the acoustical alarm means from the person's fetus and organs, the alarm means comprising:

A. means for generating an audible alarm;

B. an enclosure for the alarm means having a frontal audible alarm emission point; and C. means for minimizing acoustical coupling of vibrations and sounds placed between the means for generating the audible alarm and said enclosure, to reduce coupling of vibrations and sounds from the alarm means to the person's fetus and organs through said enclosure at said frontal audible alarm emission point; wherein the enclosure for the alarm means is worn in a pocket or is used in conjunction with a clothing material comprising one of a drape, a belt, and pairs of slacks such that said clothing material is placed between the enclosure and the person's skin and thus does not contact the person's skin, therefore additionally reducing exposure of the person's fetus and organs to the sounds and vibrations generated by the portable magnetic field detection device.

2. The device of claim 1, and further comprising means for adjusting the predetermined value.

3. The portable magnetic field detection device of claim 1, wherein the means for generating the audible alarm comprises means, including but not limited to a magnetic or piezo-electric buzzer, for emitting a clear, pulsating, loud, high-pitched and audible alarm signal between about 2.6 kHz and about 3.0 kHz for several seconds when the low-frequency magnetic field surrounding the person exceeded the selected adjustable predetermined value, said audible alarm signal being directed principally in one direction forward and away from the body of the person in order to maximize attenuation of the alarm signal by abdominal wall or other underlying organ of the person, thus further reducing exposure of the fetus to the alarm signal, with high frequency signals being more attenuated by the abdominal wall and underlying structures and attracting maximum attention of the person wearing the device.

4. The device of claim 1, wherein the alarm means additionally comprises a visible light, said light comprising two or more light emitting diodes, with the audible alarm signal being turned on and off when the light emitting diodes are turned on and off and with a distinct slow warble being created in the sound of the audible alarm due to the lack of exact synchronization in the flashing of the light emitting diodes resulting from tolerances in integral flashing circuitries of diodes.

5. The device of claim 1, wherein the magnetic field detection means comprises means for reducing susceptibility to transient magnetic fields.

6. The portable magnetic field detection device of claim 1, wherein the magnetic field detection means is capable of detecting magnetic fields simultaneously at several locations around the body of the person and comprises a plurality of means, each of said plurality of means for detecting orthogonal components of the ambient, low-frequency magnetic field and each for producing three output signals indicative of the magnitude of the respective orthogonal components, with the output signals of each of said plurality of means separately mixed in a diode network and fed into an averaging circuit that provides different selected charging and discharging time constants to avoid false alarms caused by short-lasting magnetic pulses, and a means for selecting the output signal with the greatest magnitude of all the output signals, said magnitude indicative of the magnitudes of the three orthogonal components of all the orthogonal component detection means to generate the first electrical signal, with any single output signal magnitude exceeding the predetermined value sufficient to trigger the alarm means.

* * * * *